US007219743B2

(12) United States Patent
Wolters et al.

(10) Patent No.: US 7,219,743 B2
(45) Date of Patent: May 22, 2007

(54) METHOD AND APPARATUS TO ISOLATE A WELLBORE DURING PUMP WORKOVER

(75) Inventors: Sebastiaan J. Wolters, Kingwood, TX (US); Raymond D. Chavers, Humble, TX (US); John Cobb, Humble, TX (US); Alfredo Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 203 days.

(21) Appl. No.: 10/931,606

(22) Filed: Sep. 1, 2004

(65) Prior Publication Data

US 2005/0095156 A1 May 5, 2005

Related U.S. Application Data

(60) Provisional application No. 60/499,903, filed on Sep. 3, 2003.

(51) Int. Cl.
*E21B 43/12* (2006.01)

(52) U.S. Cl. ..... 166/377; 166/378; 166/332.4; 166/66.7; 166/105

(58) Field of Classification Search ..... 166/377, 166/378, 332.4, 66.7, 105
See application file for complete search history.

(56) References Cited

U.S. PATENT DOCUMENTS

| | | | | |
|---|---|---|---|---|
| 3,375,874 A | | 4/1968 | Cherry et al. | 166/114 |
| 3,750,700 A | | 8/1973 | Ecuer | 137/498 |
| 4,407,363 A | | 10/1983 | Akkerman | 166/183 |
| 5,074,361 A | * | 12/1991 | Brisco et al. | 166/377 |
| 5,156,220 A | | 10/1992 | Forehand et al. | 166/386 |
| 5,309,993 A | | 5/1994 | Coon et al. | 166/115 |
| 5,316,084 A | | 5/1994 | Murray et al. | 166/332 |
| 5,479,989 A | * | 1/1996 | Shy et al. | 166/332.4 |
| 6,598,675 B2 | * | 7/2003 | Bussear et al. | 166/66.7 |

FOREIGN PATENT DOCUMENTS

| | | |
|---|---|---|
| GB | 2223252 | 4/1990 |

* cited by examiner

*Primary Examiner*—David Bagnell
*Assistant Examiner*—Matthew J. Smith
(74) *Attorney, Agent, or Firm*—Madan, Mossman & Sriram, P.C.

(57) ABSTRACT

A system and method for actuating a shut-off valve in a wellbore wherein the shut-off valve element can be positively closed before the pump is removed from the well. A hydraulic actuator component is operably associated with the shut-off valve to provide for selective isolation of the well by positive closing of the valve prior to removal of the pump and opening of the valve after replacement of a pump within the wellbore. The hydraulic actuator component has a balanced hydraulic design wherein the valve closure element may be moved toward an open or closed position by flow of hydraulic fluid through first and second hydraulic lines. When a repaired pump or replacement pump is placed into the well, the actuator is stabbed into a packer element to seat it. The hydraulic actuator assembly is then operated to open the shut-off valve, thereby reestablishing well operation.

17 Claims, 7 Drawing Sheets

METHOD AND APPARATUS TO ISOLATE A WELLBORE DURING PUMP WORKOVER

The present application claims the priority of U.S. Provisional patent application Ser. No. 60/499,903 filed Sep. 3, 2003.

BACKGROUND OF THE INVENTION

1. Field of the Invention

The invention relates generally to systems and methods for shutting in and isolating a production reservoir in association with the operation of pulling a failed artificial-lift pump from a well.

2. Description of the Related Art

During the later stages of production of hydrocarbons from a wellbore, downhole artificial lift pumps are often used to help assist hydrocarbons from the well. Unfortunately, these pumps occasionally suffer breakdowns or malfunction and tend to have a lifespan of only 2–3 years, in any case. When a pump become non-operational, the pump is pulled from the wellbore and either repaired or replaced with a new pump during a workover of the well. In order to remove the pump from the wellbore, it is necessary to close off, or isolate, the well below the pump against fluid flow. If the well remains live while the pump is being removed, pressurized fluid could be forced to the surface very quickly, resulting in a dangerous situation at the wellhead and potentially reducing the ability of the well to produce further.

One technique for isolating a well is to "kill" the well by introducing fluids, such as seawater, at the surface of the well to increase the hydrostatic pressure within the well to a point where it is higher than the formation pressure. The problem with this technique is that it is usually undesirable to introduce fluids into the formation below, as such may reduce the quality and quantity of production fluid that may be obtained from the well later.

A second method for isolating the well is to provide a shut-off valve below the pump that is being removed and then to close the shut-off valve as the pump is removed from the well. A conventional shut-off valve arrangement is a sliding sleeve valve having lateral fluid openings with an internal sleeve that is axially moveable between positions that open and close against fluid communication. A sliding sleeve cut-off valve of this type is described in, for example, U.S. Pat. No. 5,156,220 issued to Forehand et al. and U.S. Pat. No. 5,316,084 issued to Murray et al. Each of these patents are owned by the assignee of the present invention and are hereby incorporated by reference. A shut-off valve assembly of this type is also available commercially from the Baker Oil Tools division of Baker Hughes Incorporated as the Model "CMQ-22" Sliding Sleeve.

Typically, the valve element of the sliding sleeve valve is closed solely by the action of removing the pump. The pump has a stinger extending downwardly therefrom with a shifting collet on the lower end. The shifting collet is formed to engage the sleeve element of the sliding sleeve valve. When the pump is pulled from the wellbore, a tubing hanger pressure seal at the surface of the well is breached. The shifting collet is then pulled upwardly and moves the sleeve member of the sliding sleeve valve upwardly as well. When the repaired pump or replacement pump is to be disposed into the well, the stinger with shifting collet is secured to the lower end of the repaired/replaced pump. As the pump is run into the wellbore, the shifting collet once more engages the sleeve element of the sliding sleeve valve and, this time, moves the sleeve element axially downwardly within the valve to open the lateral fluid ports to fluid communication.

This procedure for opening and closing the shut-off valve, while simple, presents practical problems. Because the well is live, there is typically a significant pressure differential across the shut-off valve. The inventors have recognized that, if the valve is not positively closed at the time the pump is removed, pressure may escape from the well below the pump. With the procedure where the sleeve element is closed by pulling the pump from the well, the valve is not fully closed until the pump is raised some distance within the wellbore, thereby permitting such an escape of pressure.

The present invention addresses the problems of the prior art.

SUMMARY OF THE INVENTION

The invention provides an improved system and method for actuating the shut-off valve wherein the shut-off valve element can be positively closed before the pump is removed from the well. In described embodiments, an actuator component is operably associated with the shut-off valve to provide for selective isolation of the well by positive closing of the valve prior to removal of the pump and opening of the valve after replacement of a pump within the wellbore. In one preferred embodiment, the hydraulic actuator component has a balanced hydraulic design wherein the valve closure element may be moved toward an open or closed position by flow of hydraulic fluid through first and second hydraulic lines. Following closure of the shut-off valve to close off the well, the pump may be removed by simply pulling it from the well. When a repaired pump or replacement pump is placed into the well, the actuator assembly is stabbed into a packer element to seat it. The hydraulic actuator assembly is then operated to open the shut-off valve, thereby reestablishing well operation. Alternatively, the actuator component is an electrically operated actuator.

A number of alternative exemplary embodiments of the invention are described for integration of the actuator component into the production string. In alternative embodiments, differing stinger assemblies are used to engage the actuator with the sleeve valve. Additionally, the actuator assembly may be configured to be reversibly landed upon a sleeve valve assembly.

The systems and methods of the present invention may be used to retrofit present systems and to supplement existing shut-off valves and packer assemblies to provide for improved operation.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
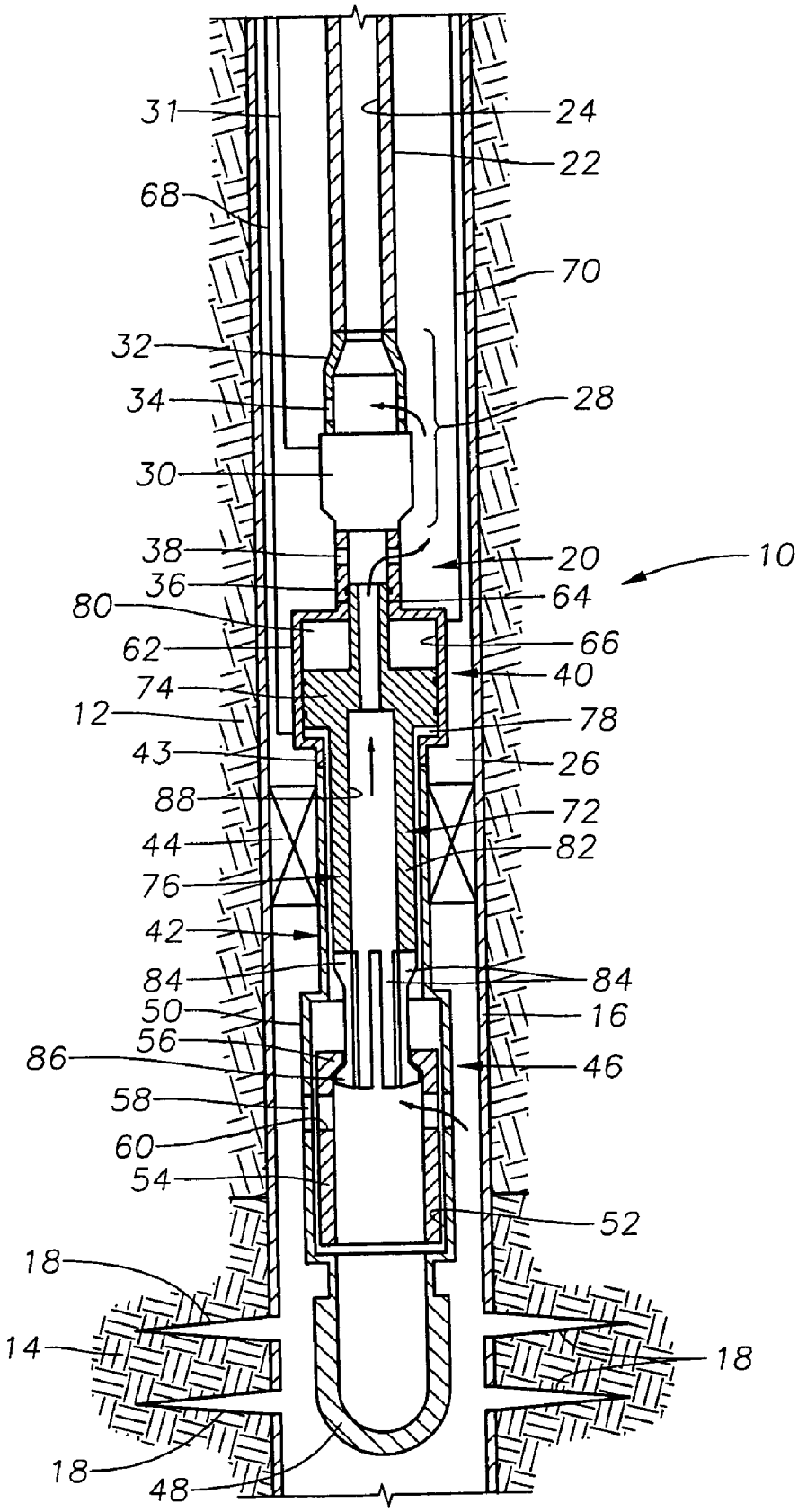
FIG. 1 is a side, cross-sectional view of an exemplary production assembly containing a pump, shut-off valve and valve actuator constructed in accordance with the present invention.

FIG. 1 depicts an exemplary wellbore 10 that has been drilled through the earth 12 and into a formation 14 from which it is desired to produce hydrocarbons. The wellbore 10 is cased by metal casing 16, and a number of perforations 18 penetrate the casing 16 to extend into the formation 14 so that production fluids may flow from the formation 14 into the wellbore 10. The wellbore 10 has a late-stage production assembly, generally indicated at 20, disposed therein by a tubing string 22 that extends downwardly from the surface of the wellbore 10 and defines an internal axial flowbore 24 along its length. An annulus 26 is defined between the production assembly 20 and the wellbore casing 16. For the sake of clarity and brevity, descriptions of most threaded connections between tubular elements, elastomeric seals, such as o-rings, and other well-understood techniques are omitted in the description that follows.

At its upper end, the production assembly 20 includes an artificial lift pump, such as electrical submersible pump 28 that is of a type known in the art for pumping hydrocarbons to the surface of a well. Because the structure and operation of electrical submersible pumps is well known, they will not be described in detail here. It is noted, however, that the pump 28 includes a motor section 30 and an inlet section 32 having lateral fluid flow ports 34 therein. At its lower end, the pump 28 is secured to a ported sub 36 that also contains a plurality of lateral fluid flow ports 38 therein. A power conduit 31 extends from the surface of the well 10 to provide electrical power to the motor section 30. The lower end of the ported sub 36 is affixed to a hydraulic actuation assembly 40, the structure and function of which will be described in detail shortly. Alternatively, the actuation assembly may be electrically driven, for example, by tapping off of the power conduit 31.

The hydraulic actuation assembly 40 is secured at its lower end to a packer assembly 42. It is noted that there is a separable snap-latch connection 43 between the lower end of the hydraulic actuation assembly 40 and the packer assembly 42. The snap-latch connection 43 is of a type known in the art to allow for a snap-in connection to a threaded end piece and reversible release by application of a sufficient tensional load, such as, for example 8,000 to 12,000 lbs. tension. Typically, such connections are provided by a collected end with exterior wickers that are shaped and sized to reversibly reside within the threads of a box-type end joint. An example of a suitable snap-latch connection for this application is that used in the Model E™ Snap-Latch Seal Assembly available commercially from the Baker Oil Tools division of Baker Hughes Incorporated.

The packer assembly 42 is shown having a packing element 44, which is set against the casing 16 to secure the production assembly 20 in place within the wellbore 10. The packer assembly 42 may comprise any of a number of packer assemblies known in the art for anchoring a tool within a wellbore and providing a fluid seal. One suitable packer assembly for this application is the SC-2™ Packer that is available commercially from the assignee of the present invention, Baker Hughes, Incorporated. The setting operation of such devices is well known by those of skill in the art and, therefore, will not be discussed in any detail herein.

Figure 2:
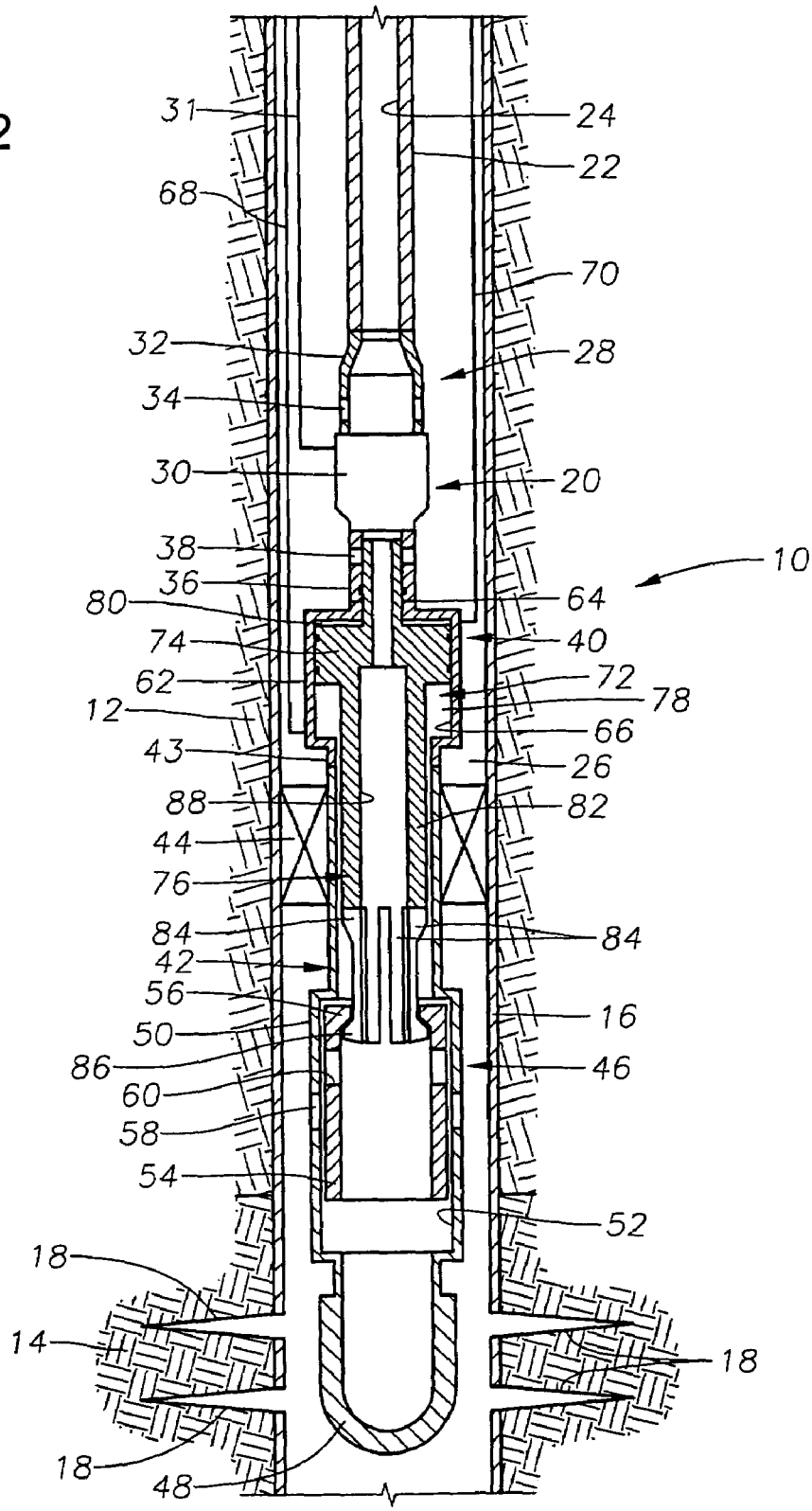
FIG. 2 depicts the production assembly shown in FIG. 1 with the shut-off valve now in a closed position.

A sliding sleeve shut-off valve assembly 46 is secured to the lower end of the packer assembly 42. A bull plug 48 is secured to the lower end of the shut-off valve assembly 46. The shut-off valve assembly 46 has an outer tubular housing 50 that defines a sleeve valve chamber 52 within. A generally tubular internal sleeve valve element 54 is located within the chamber 52 and is axially translatable within the housing 50. The upper end of the sleeve valve element 54 includes an annular profile 56. The outer housing 50 of the valve assembly 46 includes a plurality of lateral fluid openings 58. Additionally, the sleeve valve element 54 includes a number of fluid apertures 60. In this embodiment, the fluid apertures 60 are located below the profile 56 on the sleeve valve element 54. The sleeve valve element 54 is in an open position in FIG. 1, wherein the fluid apertures 60 of the sleeve valve element 54 are aligned with the lateral fluid openings 58 of the housing 50, thereby permitting hydrocarbon fluids from the formation 14 to pass into the valve assembly 46. The sleeve valve element 54 will be in a closed position, as depicted in FIG. 2, when the sleeve valve element 54 has moved to a position wherein its apertures 60 are no longer aligned with the fluid openings 58 of the housing 50. In a closed position, fluid cannot enter the valve assembly 46 due to blockage by the sleeve valve element 54.

The hydraulic actuation assembly 40 mentioned previously includes a tubular outer housing 62 having an upper axial end 64 that is threadedly secured to the ported sub 36 above and an opposite lower axial end that includes the separable snap-latch connection 43 mentioned earlier. The outer housing 62 of the actuation assembly 40 defines a generally cylindrical interior volume 66 therewithin. First and second hydraulic control lines 68, 70 extend from the surface of the wellbore 10 and are secured to nozzles or fixtures (not shown) upon the outer housing 62 of the hydraulic actuation assembly 40. The control lines 68, 70 are fluid conduits, of a type known in the art, that carry pressurized hydraulic fluid from the surface of the wellbore 10 to selectively transmit the pressurized fluid into the interior volume 66 of housing 62. Control of the flow of pressurized fluid is provided at the surface of the wellbore 10. Alternatively, the hydraulic supply system (not shown) may be located at an intermediate downhole location and control lines 68,70 connected thereto. The hydraulic supply system may be connected to and powered by a controller (not shown) at the surface.

A reciprocable stinger member 72 is retained within the hydraulic chamber 66 and is used to operate the shut-off valve 46. The stinger member 72 includes an upper piston portion 74 and an affixed lower working portion 76 that extends downwardly from the piston portion 74. The upper piston portion 74 divides the hydraulic chamber 66 into first and second fluid chambers 78, 80. The first hydraulic control line 68 communicates fluid into or out of the first fluid chamber 78 while the second hydraulic control line 70 communicates fluid into or out of the second fluid chamber 80. Each of the fluid chambers 78, 80 is made fluid-tight by the use of o-rings and other fluid sealing members that are known in the art. The piston portion 74 is moved axially within the hydraulic chamber 66 by the addition and removal of fluid from the respective fluid chambers 78, 80. Flowing pressurized fluid through the first control line 68 and into the first hydraulic chamber 78 and allowing fluid to flow from the second hydraulic chamber 80 outwardly through the second control line 70 will cause the piston portion 74 to move upwardly within the outer housing 62. Conversely, flowing pressurized fluid through the second control line 70 and into second hydraulic chamber 80 and flowing fluid from the first hydraulic chamber 78 through the first control line 68 will move the piston portion 74 downwardly within the housing 62. Alternatively, the piston may be operated in one direction by flowing pressurized hydraulic fluid into one of the hydraulic chambers and have a spring return mechanism (not shown) for returning the piston to its original position when the pressurized fluid is vented from the pressurized hydraulic chamber. The spring mechanism may be a mechanical spring and/or a pressurized gas spring of a kind known in the art.

The working portion 76 of the stinger member 72 includes a tubular sleeve 82 and a set of collet fingers 84 that extend axially therefrom. The distal end of each collet finger 84 has a radially outwardly protruding engagement portion 86 that is shaped and sized to engage the profile 56 of the sleeve valve element 54. A central axial flowbore 88 is defined along the length of the stinger member 72. The collet fingers 84 are capable of flexing radially inwardly, in a manner that is well known, to accomplish engagement between the engagement portions 86 and the profile 56. Conversely, a sufficiently high axial load, will be sufficient to cause the engagement portions 86 to be released from engagement with the profile 56. When the hydraulic actuator assembly 40 is seated upon the packer assembly 42, as shown in FIG. 1, the tubular sleeve 82 of the stinger member 72 extends through the packer assembly 42, and the engagement portions of the collet fingers 84 are engaged with the profile of the sleeve valve element 54.

Figure 3:
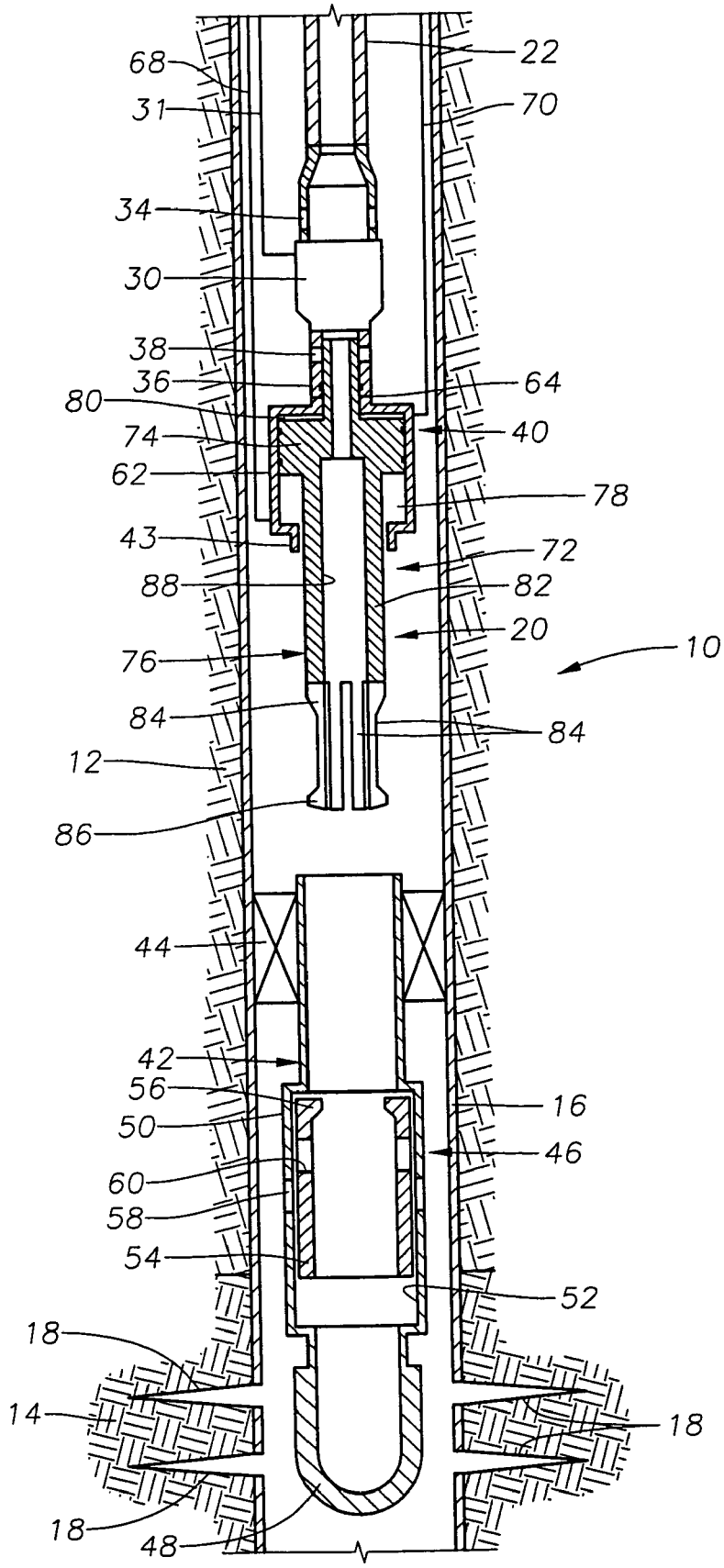
FIG. 3 depicts the production assembly of FIGS. 1 and 2 with following removal of the pump and hydraulic actuation assembly.
Figure 4C:
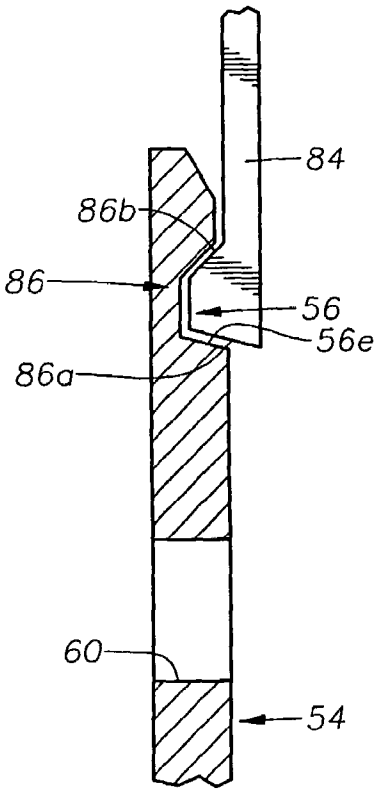
FIGS. 4*a*, 4*b*, and 4*c* are detail drawings depicting the reversible interengagement of collet fingers with the profile of the sleeve valve element.
Figure 4B:
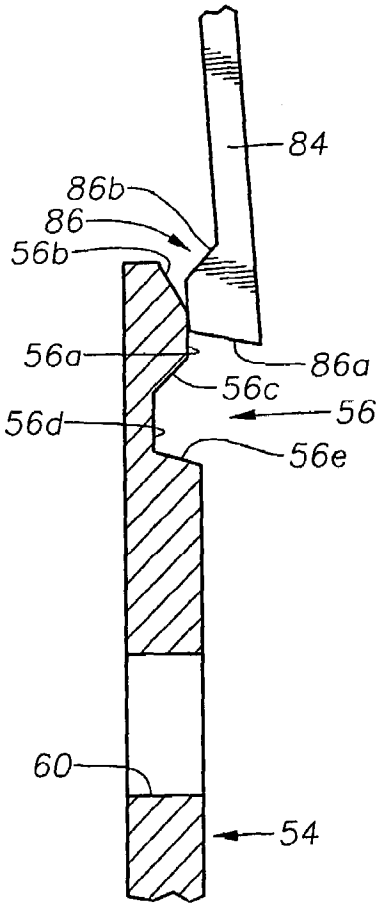
Figure 4A:
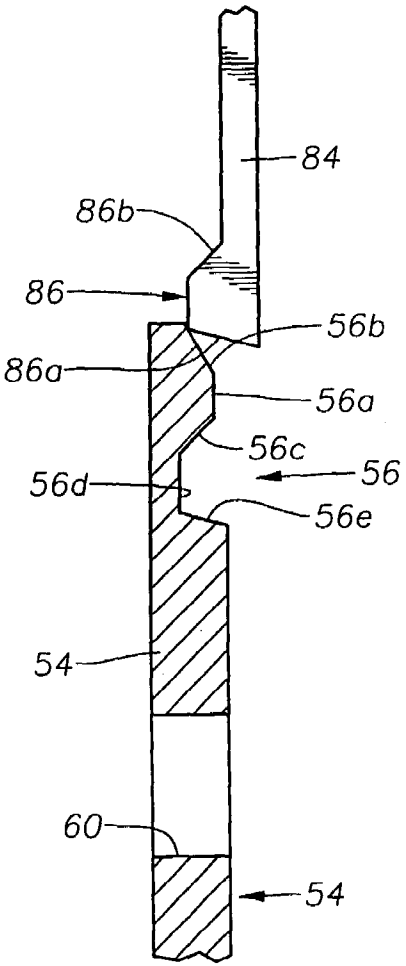

Although the engagement portions 86 of the collet fingers 84 and profile 56 of the sleeve valve element 54 are shown schematically in FIGS. 1–3, FIGS. 4*a*, 4*b*, and 4*c* depict aspects of their design and operation in greater detail. As shown there, the engagement portion 86 of the collet finger 84 includes an angled lower face 86*a* and angled upper face 86*b*. An exemplary profile 56 features an inwardly projecting ridge 56*a* with an angled upper face 56*b* and angled lower face 56*c*. An annular recess 56*d* is located below the angled lower face 56*c* and a stop face 56*e* located directly below the recess 56*d*. FIGS. 4*a*–4*c* illustrate the process of engaging the engagement portion 86 of a collet 84 with the complimentary profile 56. The lower face 86*a* of the engagement portion 86 encounters the upper angled face 56*b* of the profile 56 and the collet 84 is deflected radially inwardly (FIG. 4*b*) as the engagement portion 86 slides over the ridge 56*a* of the profile 56. Once past the ridge 56*a*, the engagement portion 86 snaps outwardly to reside within the recess 56*d* below. Engagement of the lower face 86*a* with the stop face 56*e* of the profile 56 will preclude the engagement portion 86 from moving any further downwardly with respect to the sleeve valve element 54. Release of the engagement portion 86 from the profile 56 is accomplished by exerting a sufficient upward tensional force upon the collet 84. The upper angled face 86*b* of the engagement portion 86 will slide upon the face 56*c* of the profile 56 as the collet 84 is deflected inwardly. The engagement portion 86 will pass over the ridge 56*a* and return to its released position illustrated in FIG. 4*a*. It is noted that a sufficient tensional force for releasing the collet 84 from the profile 56 should be approximately the same force as that required to release the snap-latch connection 43. The collet engagement arrangement described above is intended as an example, and not as a limitation. One skilled in the art will appreciate that the collet fingers could be located on the sleeve valve element 54 and the engagement profile could be located on the bottom of the tubular sleeve 82.

As configured in FIG. 1, in a landed and normally operational position, the production assembly 20 provides a flow path for hydrocarbons that enter the wellbore 10 from the formation 14 via perforations 18. The sleeve valve element 54 is in an open position so that hydrocarbons within the wellbore 10 below the packer element 44 can enter the valve assembly 46 via fluid openings 58 and aligned apertures 60. Under impetus of the pump 28, the hydrocarbons are then flowed upwardly through the central axial flowbore 88 of the stinger member 76. Upon exiting the axial flowbore 88, the hydrocarbons pass radially outwardly through the flow ports 38 in the ported pipe 36, bypass the motor portion 30 of the pump 28 and then enter the fluid inlets 34 of the inlet section 32 of the pump 28. From there, the hydrocarbon fluids are pumped to the surface of the wellbore 10 via the flowbore 24 of tubing string 22.

When it becomes necessary to repair or replace the pump 28, the shut-off valve 46 is first moved to a closed position, as illustrated in FIG. 2. To close the shut-off valve 46, pressurized hydraulic fluid is pumped through control line 68 and into the first hydraulic chamber 78, thereby urging the piston portion 74 upwardly within the volume 66 of the housing 62. Fluid present within the second hydraulic chamber 80 is permitted to escape via control liner 70. As the piston portion 74 is moved upwardly, the collet fingers 84 pull the sleeve valve element 54 upwardly to positively close the shut-off valve 46 and isolate the well.

FIG. 3 illustrates the production assembly 20 following closing of the shut-off valve 46 and during subsequent removal of the pump 28 from the wellbore 10. The tubing string 22 is pulled upwardly, thereby causing the snap-latch connection 43 to separate so that the housing 62 of the hydraulic actuator 40 is pulled away from the packer assembly 42 below. Additionally, the engagement portions 86 of the collet fingers 84 become disengaged from the profile 56 of the sleeve valve 54. The pump 28 and hydraulic actuator 40 are then removed from the wellbore 10.

When it is time to replace the repaired/new pump 28 into the wellbore 10, the hydraulic actuation assembly 40 is secured to the lower end of the new/repaired pump 28 and both are made up to the tubing string 22. The tubing string 22 is then lowered into the wellbore 10 until the snap-latch 43 secures the hydraulic actuator 40 to the packer assembly 42 and the collet fingers 84 snap in to engage the profile 56 of the sleeve valve element 54. When this is done, the production assembly 20 is once again in the configuration depicted in FIG. 2, with the shut-off valve 46 remaining in the closed position.

The production assembly 20 is then opened up to permit production of hydrocarbon fluids from the formation 44. Pressurized hydraulic fluid is pumped through the second control line 70 and into the second hydraulic chamber 80. The piston portion 74 is moved downwardly within the housing 62 of the hydraulic actuator 40 and, consequently, the sleeve valve element 54 is moved downwardly to once again align the fluid apertures 60 with the fluid openings 58 so that hydrocarbons may enter the shut-off valve 46 and be pumped to the surface upon subsequent operation of the pump 28.

Figure 5:
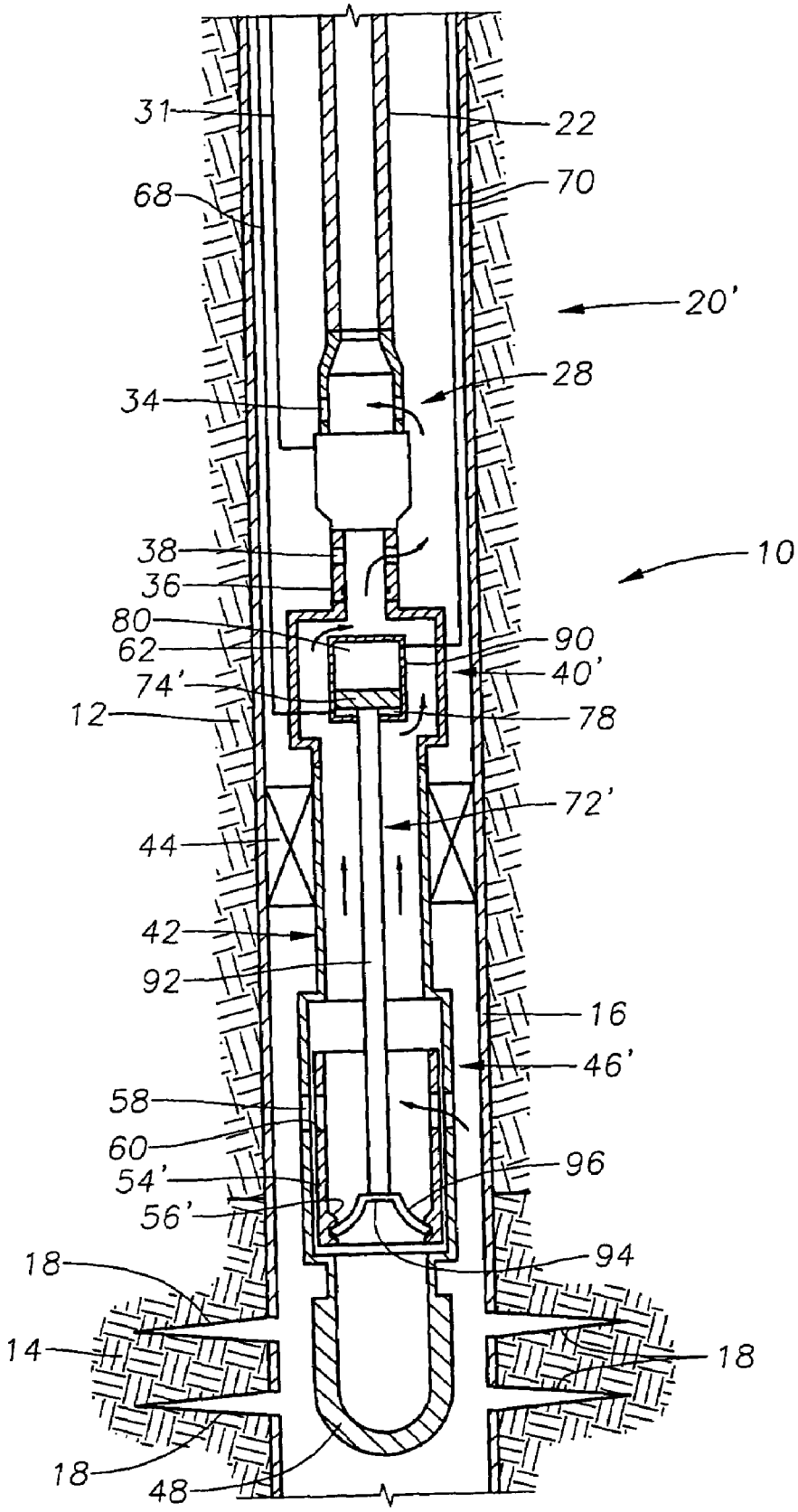
FIG. 5 is a side, cross-sectional view of an alternative embodiment for an exemplary production assembly constructed in accordance with the present invention.

Referring now to FIG. 5, an alternative embodiment for a production assembly 20' is shown. In this embodiment, the fluid openings 60 of the sleeve valve element 54' are located above the profile 56', which is located proximate the lower end of the sleeve valve element 54'. The hydraulic actuator assembly 40' has been modified to allow for engagement of the lower profile 56' as well as for fluid flow radially outside of the modified stinger member 72'. Except where indicated otherwise, structure and operation of the production assembly 20' is the same as that of the production assembly 20 described earlier. The hydraulic actuator assembly 40' features an inner housing 90, in addition to the outer housing 62 described earlier. The inner housing 90 is suspended from the pump 28 and encloses the piston portion 74' of the modified stinger member 72'. First and second hydraulic chambers 78, 80 are defined inside of the inner housing 90. The first and second control lines 68, 70 extend through the outer housing 62 as well as the inner housing 90 to provide fluid communication with the first and second hydraulic chambers 78, 80. The modified stinger member 72' also includes a working portion prong 92 that extends downwardly from the piston portion 74' through the packer assembly 42. The lower end of the prong 92 has an affixed shoe member 94 with radially extending engagement portions 96 that are shaped and sized to engage the profile 56' of the sleeve valve element 54' in a manner similar to the engagement portions 86 described previously.

When the production assembly 20' is in a producing configuration, as shown in FIG. 5, hydrocarbons flow into the shut-off valve 46' and upwardly through the packer assembly 42. Flow occurs through the hydraulic actuator 40' outside of the inner housing 90 and within the outer housing 62 and then through the ports 38 of ported pipe 36 and into the inlets 34 of pump 28.

Figure 6A:
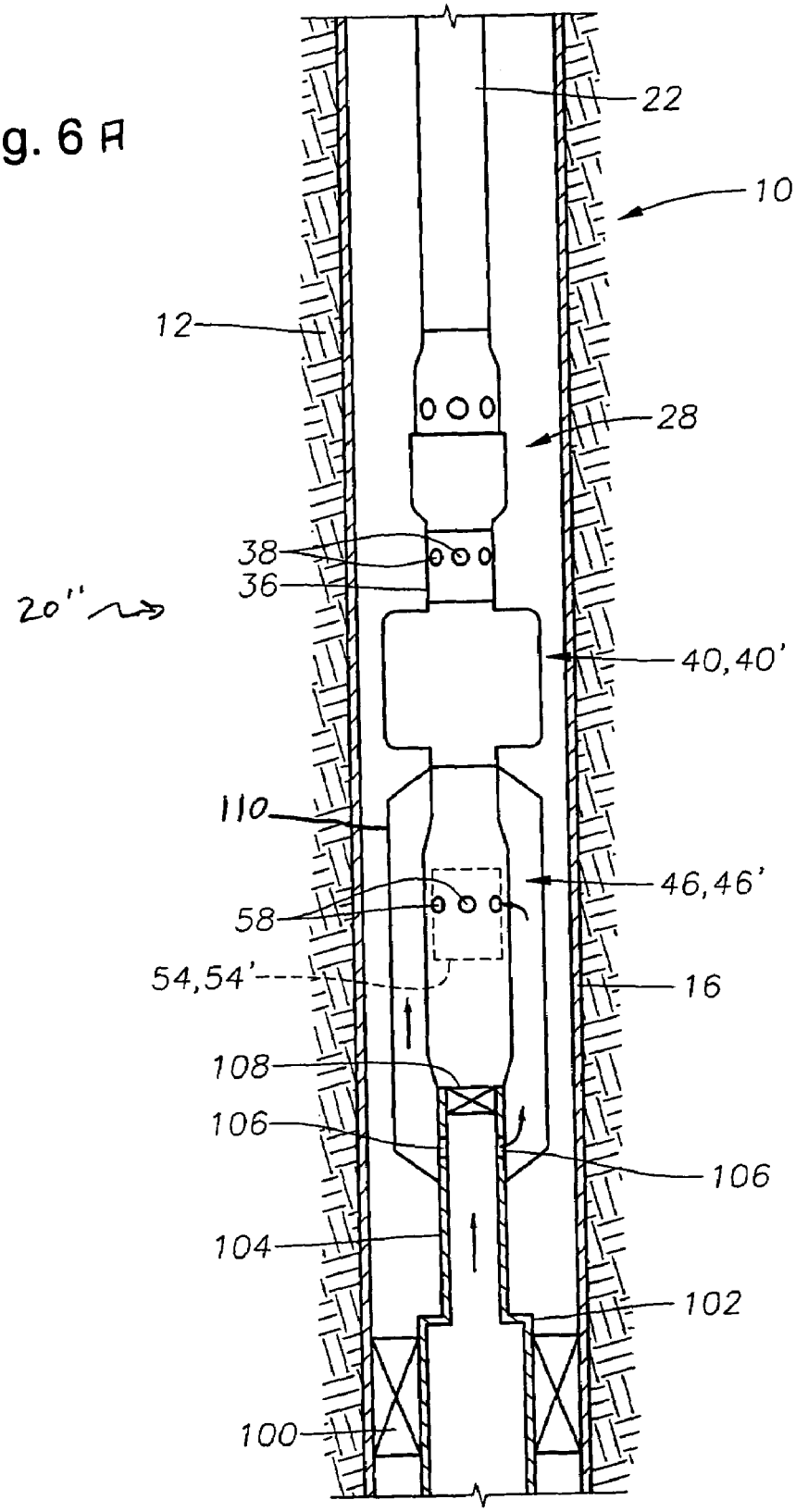
FIG. 6A is a side, partial cross-section view of a further alternative embodiment for an exemplary production assembly constructed in accordance with the present invention.
Figure 6B:
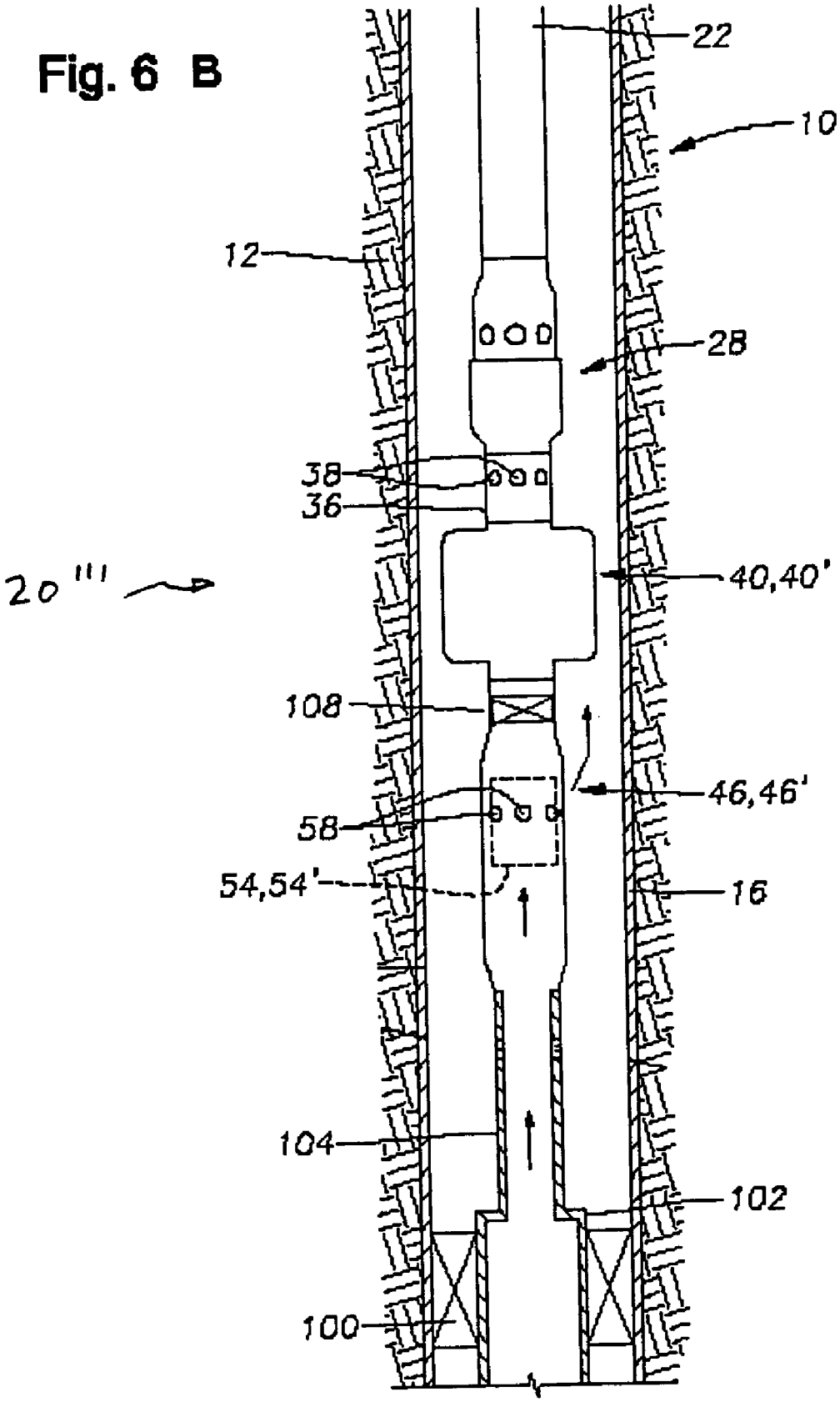
FIG. 6B is a side, partial cross-section view of a further alternative embodiment for an exemplary production assembly constructed in accordance with the present invention.

Referring now to FIG. 6A, a further alternative embodiment for a production assembly 20" is depicted in partial cross-section. In this construction, the producing formation (not shown) is located below a production packer 100 that seals against casing 16 to secure a section of production tubing 102 within the wellbore 10. The production tubing 102 is secured, at its upper end, to a pipe segment 104 having lateral fluid apertures 106 and that is sealed at its upper end by a wireline-set plug 108. A shut-off valve, having the design of either valve 46 or 46' described earlier, is secured to the pipe segment 104 above the plug 108. An exterior shroud 110, of a type known in the art, radially surrounds and is secured to the pipe segment 104 and valve 46 or 46' so that fluid passing upwardly through the pipe segment 104 may pass outwardly through apertures 106 and then radially inwardly into the shut-off valve 46,46' via exterior openings 58 when the shut-off valve 46,46' is in an open position. The remainder of the fluid flow path will be the same as that described earlier with respect to the previous embodiments. In an alternative embodiment, see FIG. 6B, a production assembly 20'" provides a non-shrouded assembly that operates similar to that of FIG. 6A. Here, however, plug (108) is located above flow ports 58 and tubular 104 is solid (not perforated).

A hydraulic actuation assembly, having either the configuration of assembly 40 or 40' described earlier, is reversibly secured upon the upper end of the shut-off valve 46, 46' in order to operate the shut-off valve 46, 46'. It is noted that the stinger member of the hydraulic actuation assembly 40, 40' will be considerably shortened in this embodiment, as compared to the previously described embodiments since the stinger need not pass through an intervening packer. Additionally, the design of the actuation assembly (either that or 40 or 40') is dependent upon the location of the profile 56, 56' upon the sleeve valve element 54, 54' within the shut-off valve 46, 46'.

It can be seen that, in each instance described above, the present invention provides a production assembly that has a lower production portion with a shut-off valve, such as a sleeve valve, that is selectively moveable between open and closed positions. In addition, the production assembly has an upper production portion that can be selectively landed upon and removed from the lower production portion. The upper production portion includes a fluid pump and a stinger assembly for engagement of the shut-off valve and movement of the valve between open and closed positions. Also, the upper production portion includes a hydraulic actuator for movement of the stinger assembly.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. An actuator assembly for a shut-off valve within a wellbore, the actuator assembly comprising:

a hydraulic chamber having a first fluid chamber and a second fluid chamber;

a piston member positioned between the first fluid chamber and the second fluid chamber and moveable between a first position and a second position therewithin upon application of fluid pressure to one of the first fluid chamber and the second fluid chamber;

the piston member selectively engaging the shut-off valve within the wellbore, wherein movement of the piston member to the first position causes the shut-off valve to be substantially opened and movement of the piston member to the second position causes the shut-off valve to be substantially closed.

2. The actuator assembly of claim 1 further comprising a fluid control line is in fluid communication with each fluid chamber.

3. The actuator assembly of claim 1 wherein the working portion further comprises a stinger portion that is selectively connectable with the sleeve member portion of a sleeve valve.

4. The actuator assembly of claim 3 wherein the stinger portion further comprises a collet finger for selective engagement of the sleeve member.

5. The actuator assembly of claim 1 wherein the working portion and the piston member define a central axial bore that permits production fluid to pass through the actuator assembly.

6. A production assembly for use within a wellbore, the production assembly comprising:

(a) a lower production assembly portion having a shut-off valve that is selectively actuatable between a first position wherein fluid can be communicated through the valve and a second position wherein the valve is closed against fluid communication; and (b) an upper production assembly portion that is selectively interconnectable with the lower production assembly, the upper production assembly having an actuator assembly for selectively actuating the shut-off valve, the actuator assembly being selectively interconnectable with the shut-off valve, the actuator assembly being operable from the surface, wherein the actuator assembly is a hydraulic actuator assembly that comprises:

(i) a hydraulic chamber;

(ii) a piston member retained within the chamber and moveable between a first position and a second position therewithin;

(iii) a plurality of hydraulic control lines operably interconnected with the hydraulic chamber for fluid communication therewith to move the piston member between the first and second positions; and (iv) a working portion operably associated with the piston member for selective engagement with the shut-off valve, wherein movement of the piston member to the first position causes the shut-off valve to be substantially opened and movement of the piston member to the second position causes the shut-off valve to be substantially closed.

7. The production assembly of claim 6 further comprising a fluid pump for transmitting production fluid from the lower production assembly toward a surface of the wellbore.

8. The production assembly of claim 7 wherein the upper production portion further comprises a shroud that surrounds the fluid pump.

9. The production assembly of claim 6 wherein the shut-off valve comprises a sliding sleeve valve.

10. The production assembly of claim 9 wherein the working portion further comprises a stinger portion having a colleted engagement portion for selectively engaging a sleeve valve member within the sliding sleeve valve.

11. The production assembly of claim 6 wherein the lower production portion further comprises a packer that anchors the shut-off valve within the wellbore.

12. The production assembly of claim 6 wherein the piston member defines a pair of fluid chambers within the hydraulic chamber and at least one of said hydraulic control lines is in fluid communication with each fluid chamber and wherein the piston member is moved within the hydraulic chamber by selective flow of hydraulic fluid into and out of the fluid chambers.

13. A method of selectively actuating a shut-off valve within a wellbore comprising the steps of:

disposing an actuator assembly within the wellbore;

landing the actuator assembly upon a lower production portion within the wellbore;

engaging a working portion from the actuator assembly with the shut-off valve;

operating the actuator assembly from the surface;

actuating the shut-off valve between an open position and a closed position;

actuating the shut-off valve to the closed position; and removing a pump from the wellbore following said actuation to the closed position.

14. The method of claim 13 wherein the step of actuating the shut-off valve comprises sliding a sleeve member within the shut-off valve between and open position and a closed position.

15. The method of claim 13 further comprising the steps of:

replacing the pump in the wellbore; and actuating the shut-off valve to the open position.

16. The method of claim 15 further comprising the step of actuating the pump to flow production fluid from the wellbore.

17. The method of claim 13 wherein the step of engaging the shut-off valve with the working portion comprises securing a colleted end of the working portion to a sleeve member within the valve.

* * * * *